US006467271B2

(12) United States Patent
Youn

(10) Patent No.: US 6,467,271 B2
(45) Date of Patent: Oct. 22, 2002

(54) SYSTEM AND METHOD FOR CONTROLLING VOC EMISSIONS

(75) Inventor: Kun C. Youn, Houston, TX (US)

(73) Assignee: Weeco International Corporation, Houston, TX (US)

( * ) Notice: Subject to any disclaimer, the term of this patent is extended or adjusted under 35 U.S.C. 154(b) by 0 days.

(21) Appl. No.: 09/772,221

(22) Filed: Jan. 30, 2001

(65) Prior Publication Data

US 2002/0100277 A1 Aug. 1, 2002

(51) Int. Cl.[7] ..... F02G 3/00
(52) U.S. Cl. ..... 60/614; 60/619; 123/523
(58) Field of Search ..... 123/523; 60/597, 60/614, 619

(56) References Cited

U.S. PATENT DOCUMENTS 4,237,689 A * 12/1980 Sampietro ..... 60/599
5,050,603 A * 9/1991 Stokes et al. ..... 123/523
5,181,796 A * 1/1993 De Young ..... 405/128
5,450,728 A * 9/1995 Vora et al. ..... 62/23
5,540,057 A * 7/1996 Cheng ..... 62/625

* cited by examiner

*Primary Examiner*—Hoang Nguyen
(74) *Attorney, Agent, or Firm*—Bill B. Berryhill

(57) ABSTRACT

An improved system for controlling emissions of VOC's by combustion of the VOC's in an internal combustion engine, comprising: a chiller through which the VOC's pass for condensing some of the VOC's into useable liquid products, the remaining VOC's being directed through piping to the engine as the primary fuel therefor; and a refrigeration unit connected to the engine and powered thereby, the refrigeration unit being connected by other piping to the chiller providing refrigerant thereto for the condensing of some of the VOC's passing therethrough.

21 Claims, 1 Drawing Sheet

SYSTEM AND METHOD FOR CONTROLLING VOC EMISSIONS

BACKGROUND OF THE INVENTION

1. Field of the Invention

The present invention pertains to systems and methods for controlling emission of VOC's (volatile organic chemicals). More specifically, the present invention pertains to improved systems and methods for controlling VOC emissions by combustion of such emissions in internal combustion engines.

2. Description of the Prior Art

Volatile organic chemicals (hereinafter referred to as "VOC's") are present in storage tanks, refineries and petrochemical processing units. The recovery or destruction of VOC's has become increasingly important in recent years. Governmental regulations place strict standards on release of VOC's into the environment.

A number of systems and methods for controlling such VOC emissions have been developed. One method is the destruction of VOC's by burning in internal combustion engines, reducing the volatile organic chemicals to non-hazardous ones such as carbon dioxide and water. Engines have an advantage over incinerators because of their compactness, portability and flexibility of operation. However, most such systems of the prior art have been designed to burn only trace amounts of organic vapors from land reclamation projects. The emphasis on such systems has been placed on automatic operation rather than high capacity.

In recent years, the internal combustion engine has begun to find favor in controlling VOC emissions from refineries, chemical plants and pipeline terminals in helping to meet federal and local air pollution standards. Such applications typically require control of massive amounts of VOC vapors in short time periods. For this reason, conventional internal combustion engine systems, with limited capacities, have not been popular.

The VOC combustion capacity of an internal combustion engine is largely determined by two factors: 1) the physical vapor handling capacity of the engine, regardless of the VOC vapor composition and 2) the engine's maximum ability to burn, i.e. the BTU per hour rating. In refinery, chemical plants and pipeline terminals, the vapors are often very concentrated and have a relatively high BTU content. This decreases the volume handling capacity of the engine.

Furthermore, burning all the VOC's, in addition to reducing the capacity of such a system, results in burning VOC's which might otherwise be useful. If some of the VOC's could be recovered as liquid product, these products could be a source of revenue and would increase the volume capacity of the system by not requiring the burning of the liquid products in the engine.

SUMMARY OF THE PRESENT INVENTION

The present invention provides improved systems and methods of controlling VOC emissions by combustion of the VOC's in an internal combustion engine. In the method of the present invention, some of the VOC's are condensed into useable liquid products by passing the VOC's through a chiller. Refrigeration for the chiller is provided by a refrigeration unit driven by the internal combustion engine. In a preferred method of the present invention, the remaining VOC's pass through a blower which discharges the remaining VOC's, at a higher pressure, into the internal combustion engine as the primary fuel thereof. Furthermore, the blower is also driven by the engine. Thus, the remaining VOC's are burned in the engine and converted to carbon dioxide, water and other less noxious compounds.

In a preferred embodiment of the invention, a knockout drum is provided downstream of the chiller for collecting the condensed liquid products for eventual removal and use thereof. In addition, a source of air may be provided to the blower suction for mixing with the remaining VOC's and discharge therewith at a high pressure into the engine. If desired, a source of supplemental fuel may be provided downstream of the blower for supplementing the primary VOC fuel as needed.

Thus, the present invention provides an improved system and method for controlling emissions of VOC's by combustion in internal combustion engines. The blower extracts the VOC vapor stream and injects or supercharges it into the engine. This substantially increases the vapor handling capacity of the engine compared to naturally aspirated engines. The loading of the engine by driving the refrigeration unit and the blower increases its combustion capacity.

Furthermore, chilling and condensing some of the VOC's into useable liquid products results in potential revenue. The condensation also reduces vapor concentration, lowering the BTU content of the remaining VOC's and thereby increasing the volume handling capacity of the internal combustion engine.

Many other objects and advantages of the system and method of the present invention will be apparent from reading the specification which follows in conjunction with the accompanying drawing.

DESCRIPTION OF PREFERRED EMBODIMENTS

Figure 1:
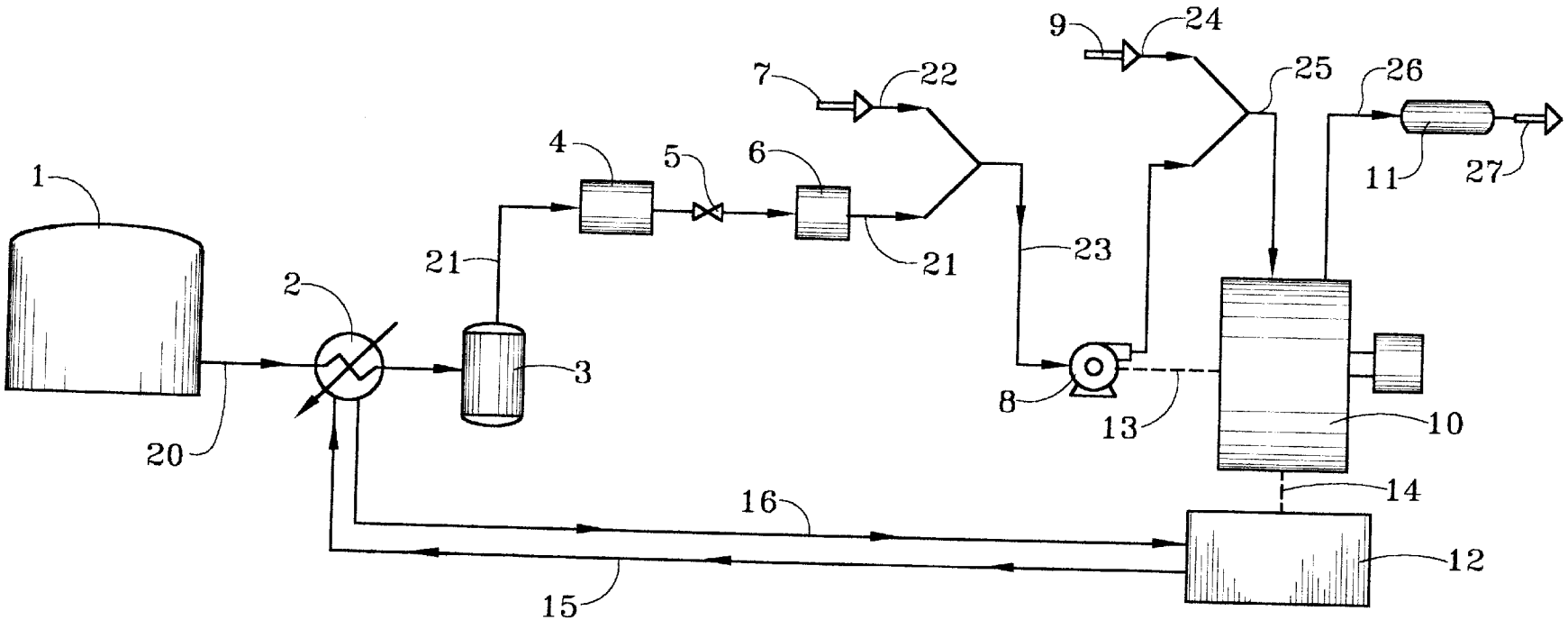
FIG. 1, is a schematic representation of the system of the present invention, according to a preferred embodiment thereof.

Referring now to FIG. 1, there is shown an above-ground storage tank for degassing or removal of VOC's therefrom. Degassing may occur before and during tank cleaning or during tank refilling. It should also be understood that the system and method of the present invention can be utilized with other degassing or VOC removal operations. For example, they can be utilized for degassing underground storage tanks, barges, tankers, etc. In fact, they can also be utilized in controlling emissions from refineries and petrochemical processing facilities.

There are a number of components which may be utilized in the system and method of the present invention. As shown in FIG. 1, they include a chiller 2, knockout drum 3, detonation arrester 4, valve 5, flame arrester 6, blower 8, internal combustion engine 10, catalytic converter 11, and refrigeration unit 12. All these components can be placed at a permanent installation or on a skid for semi-permanent installation. More likely, the components of the present invention would be mounted on a truck or trailer for movement from one location to another as needed.

The gaseous, volatile organic chemicals (VOC's) are first directed by piping or hose 20 to the chiller 2. Cold refrigerant for the chiller is transmitted from the refrigeration unit 12 through piping or hose 15. After cooling and condensing some of the VOC's, the heated refrigerant returns through the piping or hose 16 to the refrigeration unit 12. As the VOC's pass through the chiller 2 some of it is condensed into useable liquid products which are collected in the knockout drum 3 for eventual removal and use. This of course can be a source of additional revenue.

The remaining VOC's are directed by piping or hose 21 through a detonation arrestor 4, valve 5 and flame arrestor 6 and may be combined with air from an air source 7, piping 21 and 22 joining for further downstream passage through piping 23. The remaining VOC's and air, if added, then pass to the suction of blower 8 for discharge at a higher pressure and through piping 25 into the engine 10 as the primary fuel therefor. In some cases it may be necessary to provide supplemental fuel to the engine 10. Thus, a source of supplemental fuel 9 may be connected through piping 24 to join VOC's passing through piping 25 into the engine 10. Alternatively, supplemental fuel can be injected directly into the engine.

The VOC's are burned as fuel in the internal combustion engine, being converted from hazardous pollutants into carbon dioxide and water. The exhaust gases from the internal combustion engine 10 are then directed through piping 26 and catalytic converter 11 where any nitrogen oxides, carbon monoxides or other unwanted hydrocarbon products are converted to less hazardous gases for discharge as clean exhaust at 27.

It will be noted that the blower 8 is connected by any suitable coupling 13 to the internal combustion engine 10. The primary purpose of the blower 8 is to extract or degas the tank 1 of its VOC's and to pull the gasses through the chiller 2, knockout drum 3, detonation arrestor 4 and the flame arrester 6. The VOC's remaining after removal of the condensed useable liquid products, along with air from the air source 7, are then injected at a higher pressure into the engine 10, supercharging the engine. This arrangement substantially increases the physical vapor handling capacity of the engine 10 as compared to naturally aspirated engines. Furthermore, the blower 8, being a load on the engine 10, also increases its combustion capacity.

It will also be noted that the refrigeration unit 12 which may have a compressor, condenser fans, pumps, etc. (not shown) is also connected by a suitable coupling 14 to the internal combustion engine 10. Thus the refrigeration unit 12 also loads the engine 10 increasing its combustion capacity.

The condensing of some of the VOC's into useable liquid products by the refrigeration unit 12, chiller 2 and knockout drum 3, reduces the vapor concentration of the remaining VOC's, lowering the BTU content thereof. Lowering the BTU content also increases the volume handling capacity of the internal combustion engine 10.

In summary, the improved system of the present invention provides an improved method of controlling emissions of VOC's by combustion in an internal combustion engine. In the improved method some of the VOC's are condensed into useable liquid products by passing through a chiller, the refrigeration of which is provided by a refrigeration unit driven by the engine. The remaining VOC's are drawn through a blower which discharges the remaining VOC's, at a high pressure, into the engine as a primary fuel thereof, the blower also being driven by the engine. Finally, the remaining VOC's are burned in the engine and, after passing through a catalytic converter, are discharged into the atmosphere as clean, combustion gas.

The system and method of the present invention are extremely efficient and capable of controlling massive amounts of VOC emissions in short periods of time. They should be much more acceptable than prior art systems which utilize internal combustion engines for controlling VOC emissions via vapor extraction and combustion.

A single embodiment of the invention and a method of use thereof are described herein. Other variations are easily seen. For example, the system could be operated, albeit less efficiently, by removing the chiller 2 and refrigeration unit 12. A number of variations in invention could be made without departing from the spirit thereof. Accordingly, it is intended that the scope of the invention be limited only by the claims which follow.

I claim:

1. An improved system for controlling emissions of VOC's by combustion of said VOC's in an internal combustion engine, said improvement comprising:

a chiller through which said VOC's pass for condensing some of said VOC's into useable liquid products, the remaining VOC's being directed through piping to said engine as the primary fuel therefor;

a refrigeration unit connected to said engine and powered thereby, said refrigeration unit being connected by other piping to said chiller providing refrigerant thereto for said condensing of some of said VOC's passing therethrough; and a blower coupled to said engine and powered thereby, said blower having a suction and discharge, said remaining VOC's passing through said piping to said blower suction for discharge at a higher pressure into said engine as said primary fuel therefor.

2. The improved system for controlling VOC emissions as set forth in claim 1 including a knockout drum downstream of said chiller, upstream of said blower and into which said condensed liquid products pass from blower chiller for collection therein.

3. The improved system for controlling VOC emissions as set forth in claim 1 including a source of air in communication with said blower suction, said air and said remaining VOC's being discharged together at a higher pressure into said engine.

4. The improved system for controlling VOC emissions as set forth in claim 1 including a source of supplemental fuel downstream of said blower for injection into said engine.

5. The improved system for controlling VOC emissions as set forth in claim 1 including a detonation arrester connected by said piping between said chiller and said blower suction.

6. The improved system for controlling VOC emissions as set forth in claim 1 including a flame arrester connected by said piping between said chiller and said blower suction.

7. The improved system for controlling VOC emissions as set forth in claim 1 in which the exhaust of said engine is connected to a catalytic converter.

8. An improved system for controlling emission of VOC's by combustion of said VOC's in an internal combustion engine, said improvement comprising:

a blower, having a suction and discharge, coupled to said engine and powered thereby, said VOC's being in fluid communication through piping with said blower suction for discharge at a higher pressure into said engine as the primary fuel therefor.

9. An improved system for controlling VOC emissions as set forth in claim 8 including a source of air connected to said blower suction for discharge, with said VOC's, at a higher pressure, into said engine.

10. An improved system for controlling VOC emissions as set forth in claim 8 including a source of supplemental fuel downstream of said blower for injection into said engine.

11. An improved system for controlling VOC emissions as set forth in claim 8 including a flame arrester through which said VOC's are piped prior to entering said blower suction.

12. An improved system for controlling VOC emissions as set forth in claim 8 in which the exhaust of said engine is connected to a catalytic converter.

13. An improved system for controlling VOC emissions as set forth in claim 8 including a chiller through which said VOC's pass for condensing of some of said VOC's into useful liquid products, the remainder of said VOC's passing through said piping to said blower suction, said chiller being provided with refrigerant from a refrigeration unit connected to said engine and powered thereby.

14. An improved system for controlling VOC emissions as set forth in claim 13 including a knockout drum downstream of said chiller, upstream of said blower and into which said condensed liquid products may collect for eventual removal and use.

15. An improved system for controlling VOC emissions as set forth in claim 14 including a detonation arrester between said knockout drum and said engine to prevent detonation of said VOC's in said knockout drum.

16. An improved method of controlling emissions of VOC's by combustion of said VOC's in an internal combustion engine, said improved method comprising the steps of:

condensing some of said VOC's into useable liquid products by passing said VOC's through a chiller, the refrigeration for which is provided by a refrigeration unit driven by said engine;

passing remaining VOC's through a blower which discharges said remaining VOC's, at a higher pressure, into said engine as the primary fuel thereof, said blower being driven by said engine; and burning said remaining VOC's in said engine as the primary fuel therefor.

17. An improved method for controlling VOC emissions as set forth in claim 16 in which air is mixed with said remaining VOC's and passed therewith through said blower for discharge into said engine.

18. An improved method for controlling VOC emissions as set forth in claim 17 which a supplemental fuel source is connected to said engine for supplementing said primary VOC fuel when needed.

19. An improved method for controlling VOC emissions as set forth in claim 16 in which said useable liquid products are collected in a knockout drum for eventual removal and use thereof.

20. An improved method for controlling VOC emissions as set forth in claim 19 in which said remaining VOC's are passed through a detonation arrester and a flame arrestor prior to said passing thereof through said blower.

21. An improved method for controlling VOC emissions as set forth in claim 16 in which the exhaust gases from burning of said remaining VOC's in said engine are passed through a catalytic converter for converting said exhaust gases into less noxious compounds.

* * * * *